US005754038A

United States Patent [19]

Durec et al.

[11] Patent Number: 5,754,038

[45] Date of Patent: May 19, 1998

[54] METHOD AND CIRCUIT FOR CURRENT REGULATION

[75] Inventors: Jeffrey C. Durec, Chandler; William E. Main, Mesa, both of Ariz.

[73] Assignee: Motorola, Inc., Schaumburg, Ill.

[21] Appl. No.: 706,879

[22] Filed: Sep. 3, 1996

[51] Int. Cl.[6] ..... G05F 3/20

[52] U.S. Cl. ..... 323/313; 323/316

[58] Field of Search ..... 323/312, 313, 323/314, 315, 316; 327/530, 538

[56] References Cited

U.S. PATENT DOCUMENTS

| | | | |
|---|---|---|---|
| 4,808,907 | 2/1989 | Main | 323/316 |
| 5,404,096 | 4/1995 | Thiel | 323/312 |
| 5,446,367 | 8/1995 | Pinney | 323/266 |
| 5,545,973 | 8/1996 | Johnson | 323/315 |

*Primary Examiner*—Peter S. Wong
*Assistant Examiner*—Y. J. Han
*Attorney, Agent, or Firm*—Rennie William Dover

[57] ABSTRACT

A current regulator (60, 90, and 100) provides current regulation. The current regulator (60, 90, and 100) has a bias generator (14) which compares a generated voltage, $V_{ref}$, with a feedback voltage generated in accordance with an output current provided in a reference circuit (57, 58, and 59). The current regulator (60, 90, and 100) operates as a bias circuit to minimize the quiescent currents for efficiently providing regulated output currents in current sink circuit (26). The current in the bias generator (14) and the current in the reference circuit (57, 58, and 59) that regulate the output current in current sink circuit (26) are a small percentage of the overall current.

18 Claims, 5 Drawing Sheets

-PRIOR ART-
10

METHOD AND CIRCUIT FOR CURRENT REGULATION

BACKGROUND OF THE INVENTION

The present invention relates, in general, to integrated circuits and, more particularly, to current regulation in the integrated circuits.

Integrated circuits are used in battery powered devices such as cellular telephones, pagers, and portable computers. Typically these devices include functional blocks such as low noise amplifiers, oscillators, etc., that have bias circuits for generating bias currents. In addition, the bias circuits include circuitry that regulates the bias currents. One technique for regulating a bias current has relied on a current mirror for scaling transistor currents. A limitation of this technique is that a large quiescent current flows which lowers the life of the batteries.

Accordingly, it would be advantageous to have a circuit that minimizes the quiescent current in generating the bias currents for the functional blocks. The bias current generation circuitry and the current regulation should be insensitive to power supply variations and provide low error in the output currents.

DETAILED DESCRIPTION OF THE DRAWINGS

Figure 1:
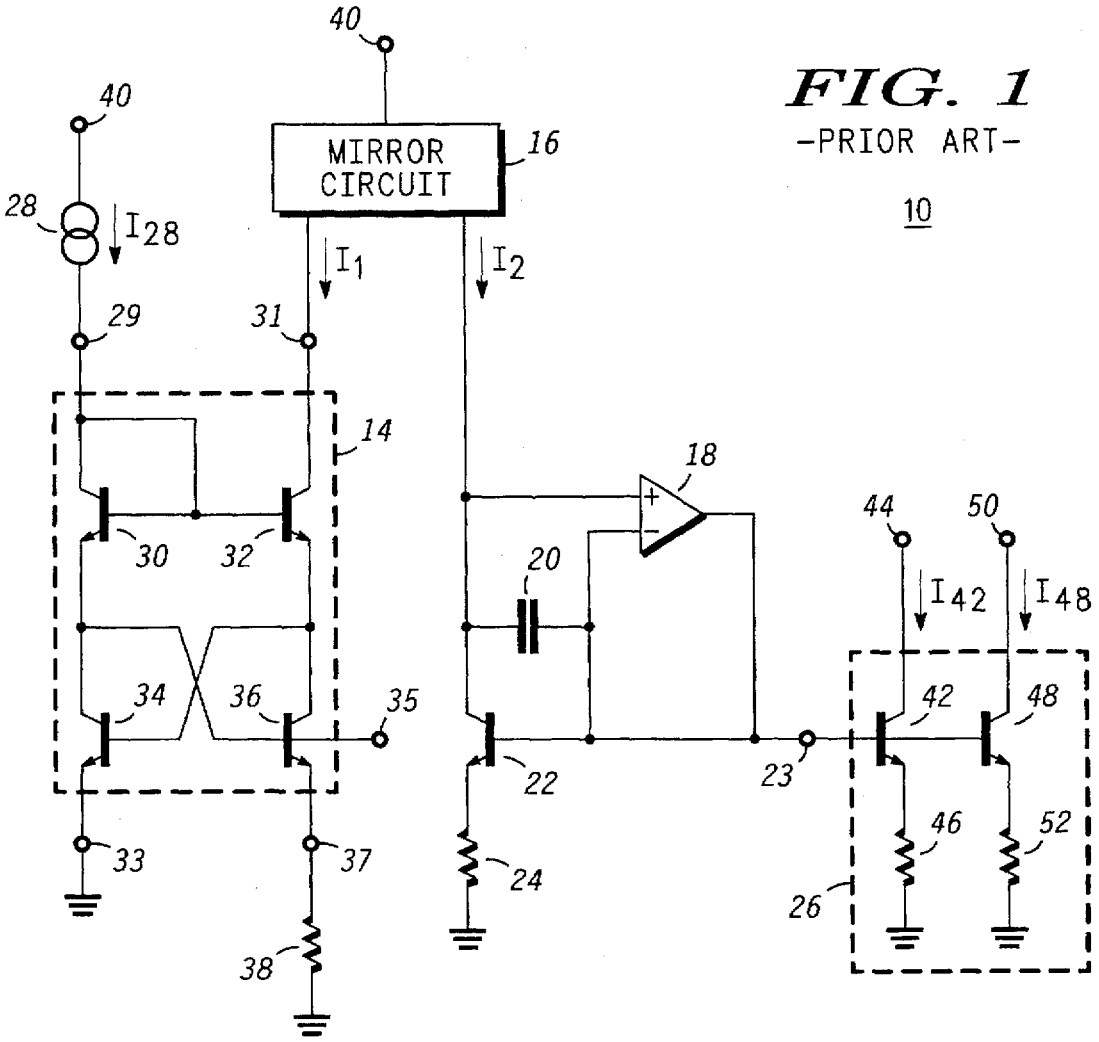
FIG. 1 is a schematic diagram of a prior art current regulator system.

FIG. 1 is a schematic diagram of a prior art current regulator 10 which is comprised of a bias generator 14, a mirror circuit 16, a current sink circuit 26, and a reference circuit. Bias generator 14 has current carrying terminals 29 and 31, bias terminals 33 and 37, and an output terminal 35. Although bias generator 14 includes an output terminal 35, it is not used in the circuit configuration of current regulator 10. Bias generator 14 is comprised of NPN transistors 30, 32, 34, and 36. The bases of transistors 30 and 32 are commonly connected to the collector of transistor 30 which is connected to input terminal 29 as a bias current input terminal of bias generator 14. The emitter of transistor 30 is commonly connected to the collector of transistor 34 and to the base of transistor 36. The emitter of transistor 32 is commonly connected to the collector of transistor 36 and to the base of transistor 34. The emitter of transistor 34 is connected to terminal 33 and the emitter of transistor 36 is connected to terminal 37 of bias generator 14. The collector of transistor 32 is connected to terminal 31.

Terminal 29 of bias generator 14 is coupled to a terminal 40 through a current source 28, which provides a current $I_{28}$ to bias generator 14. Terminal 40 is a power supply terminal coupled for receiving a power supply voltage, typically referred to as VCC. Terminal 33 of bias generator 14 is connected to ground and terminal 37 is coupled to ground via resistor 38.

Current regulator 10 includes a mirror circuit 16 which has two current conducting terminals and a bias terminal. The bias terminal is connected to terminal 40. A first current conducting terminal is connected to terminal 31 of bias generator 14 and provides a current $I_1$ thereto. A second current conducting terminal is commonly connected to a non-inverting input of a buffer 18, to the collector of an NPN transistor 22, and to a first terminal of a capacitor 20. The second current conducting terminal of mirror circuit 16 supplies the current $I_2$. A second terminal of capacitor 20 is commonly connected to an inverting input of buffer 18, to the output of buffer 18, and to the base of transistor 22. The emitter of transistor 22 is coupled to ground via a resistor 24. The output of buffer 18 is connected to an input terminal 23 of a current sink circuit 26. Bias generator 14 establishes current $I_1$. Mirror circuit 16 scales current $I_1$ to generate current $I_2$.

Current sink circuit 26 has input terminal 23 and current conducting terminals 44 and 50. More particularly, current sink circuit 26 includes two NPN bipolar transistors 42 and 48, each having a collector, a base, and an emitter. The bases of transistors 42 and 48 are commonly connected to input terminal 23. The collector of transistor 42 is connected to terminal 44 for conducting a regulated output current $I_{42}$. The emitter of transistor 42 is coupled to ground via a resistor 46. Similarly, the collector of transistor 48 is connected to a terminal 50 for conducting a regulated output current $I_{48}$. The emitter of transistor 48 is coupled to ground via a resistor 52.

In operation, bias generator 14 establishes a current $I_1$ in accordance with NPN transistors 30, 32, 34, and 36 and resistor 38. The collector current of transistor 32 has a value given by the equation:

$$I_1=(V_T/R38)\ln((A30*A36)/(A32*A34))$$

where:

$V_T$ is the thermal voltage kT/q;

k is Boltzmann's constant;

q is the electronic charge;

T is the absolute temperature (degrees Kelvin);

R38 is the resistance value of resistor 38; and

A30, A32, A34, and A36 are the emitter areas of transistors 30, 32, 34, and 36, respectively.

Mirror circuit 16 generates a current $I_2$ from current $I_1$ using well known current mirroring techniques. As those skilled in the art are aware, current $I_2$ is equal to the product of $I_1$ and a scaling factor M of mirror circuit 16, i.e., M equals $I_2/I_1$. Because mirror circuit 16 is comprised of transistors (not shown) which have a finite output resistance, variations in the supply voltage at terminal 40 of mirror circuit 16 produce variations in the ratio of the currents $I_2$ and $I_1$. The current $I_2$ supplied from mirror circuit 16 is generated to regulate the currents in the outputs of current sink circuit 26, such as the currents $I_{42}$ and $I_{48}$ which flow through terminals 44 and 50, respectively. However, currents $I_1$ and $I_2$ are appreciable and contribute to the power consumption of current regulator 10.

Figure 2:
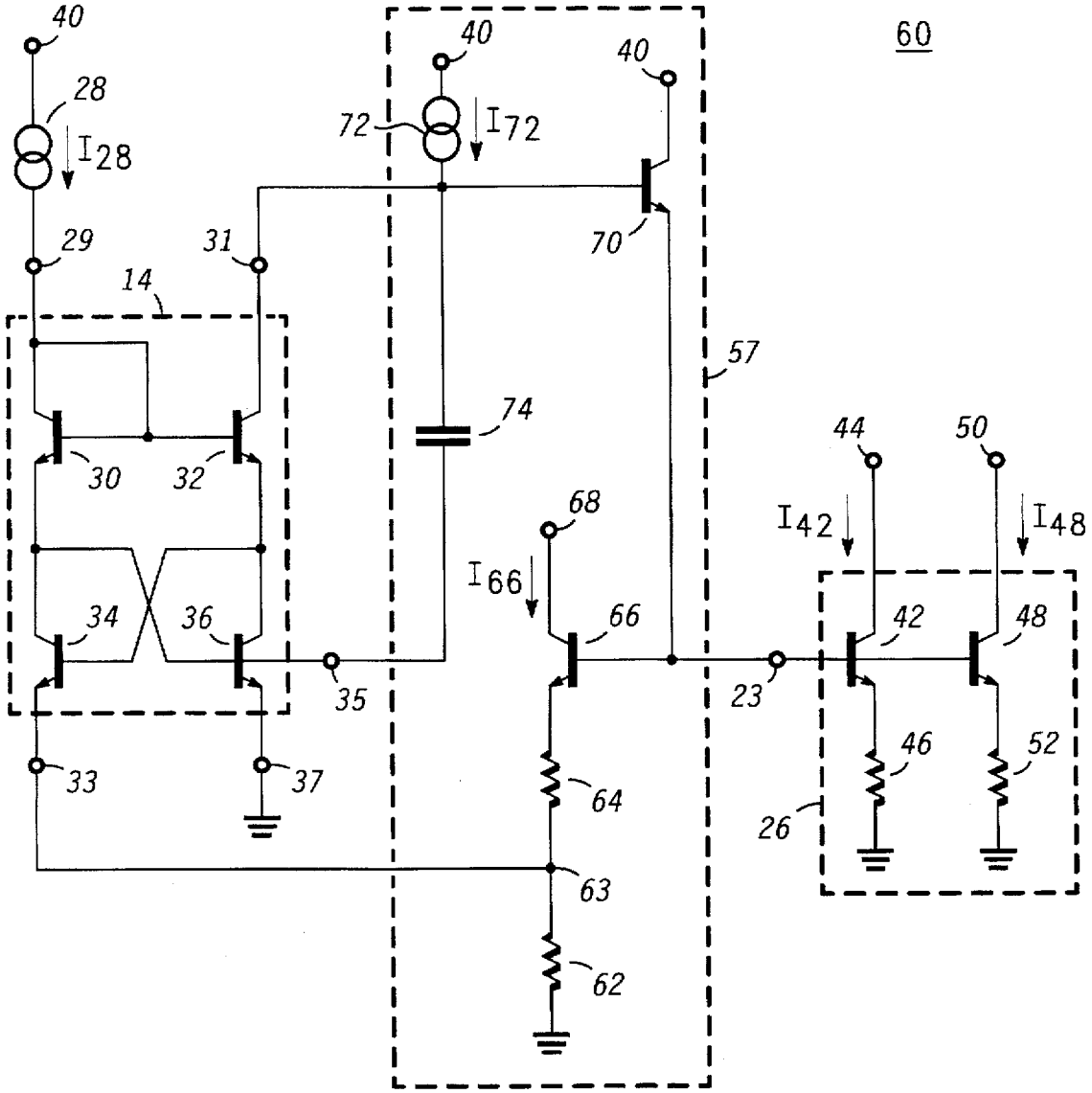
FIG. 2 is a schematic diagram of a current regulator system in accordance with a first embodiment of the present invention.

FIG. 2 is a schematic diagram of current regulator 60 in accordance with a first embodiment of the present invention. It should be understood that the same reference numerals are used in the figures to denote the same elements. Current regulator 60, which serves as a bias current regulator circuit, generates Direct Current (DC) bias currents for use in systems operating in a frequency range of about ten kilohertz to about one gigahertz. By way of example, current regulator 60 is used in Radio Frequency (RF) amplifiers, mixers, and oscillators which are commonly found in applications such as cellular telephones. More particularly, current regulator 60 may be used in applications having frequency signals in the 800–900 MegaHertz (MHz) range.

Current regulator 60 is comprised of current source 28, bias generator 14, reference circuit 57, and current sink circuit 26. In accordance with the first embodiment of the present invention, terminal 37 of bias generator 14 is connected to ground and terminal 31 is coupled to terminal 40 via reference circuit 57.

Reference circuit 57 includes resistors 62 and 64, a capacitor 74, NPN transistors 66 and 70, and a current source 72 which provides a current $I_{72}$. Transistors are three terminal devices formed with a collector as a first current carrying electrode, a base as a control electrode, and an emitter as a second current carrying electrode. The emitter of NPN transistor 66 is coupled to ground through resistors 62 and 64. By way of example, resistors 62 and 64 have values of about one thousand ohms and two thousand ohms, respectively. A first terminal of resistor 64 is connected to the emitter of transistor 66 and a second terminal of resistor 64 is connected to a first terminal of resistor 62. A second terminal of resistor 62 is coupled to receive a second source of operating potential, such as, for example, ground. Because the first terminal of resistor 62 and the second terminal of resistor 64 are commonly connected, they form a node 63. Node 63 is connected to terminal 33 of bias generator 14. The collector of transistor 66 is connected to terminal 68 which serves as a regulated current output terminal for sinking a regulated output current. The emitter of transistor 70 and the base of transistor 66 are commonly connected and serve as the control output of reference circuit 57. The collector of transistor 70 is connected to terminal 40. The base of transistor 70 is connected to terminal 31 of bias generator 14 and serves as a base drive reference input of reference circuit 57.

Output terminal 35 is coupled to the base of transistor 70 through a capacitor 74. Current source 72 is coupled between terminal 40 and terminal 31 and supplies a current, $I_{72}$, to bias generator 14. By way of example, current $I_{72}$ has a value of about fifty microamps, current $I_{28}$ has a value of about ten microamps, and capacitor 74 has a value of about one picofarad.

In operation, a feedback loop is established for adjusting and regulating the current in transistors 42 and 48 of current sink circuit 26 and transistor 66 of reference circuit 57. Reference circuit 57 operates as a feedback circuit by providing a voltage at reference voltage output node 63 which is fed back to bias generator 14. Transistors 30, 32, 34, and 36 of bias generator 14 operate to provide current regulation such that the current $I_{66}$ has a value given by:

$$I_{66}=(V_T/R62)\ln((A32*A34)/(A30*A36))-I_{28}$$

where:

$V_T$ is the thermal voltage kT/q;

k is Boltzmann's constant;

q is the electronic charge;

T is the absolute temperature (degrees Kelvin);

R62 is the resistance value for resistor 62;

$I_{28}$ is the current flowing from current source 28; and

A30, A32, A34, and A36 are the emitter areas of transistors 30, 32, 34, and 36, respectively.

Bias generator 14 generates a reference voltage having a value $V_{ref}$ which appears at terminal 33. The value of $V_{ref}$ is given by the equation:

$$V_{ref}=V_T*\ln((A32*A34)/(A30*A36)).$$

Thus, bias generator 14 provides a predetermined voltage at terminal 33, as the comparison input terminal, for comparison against the voltage generated across resistor 62 at node 63 in response to current $I_{66}$. The comparison of the predetermined voltage to the voltage at node 63 results in a current flowing into bias generator 14 at terminal 31 and the current is referred to as a comparison result. It should be understood that the portion of the total current flowing through resistor 62 that is supplied by transistor 34 is considerably smaller than the current $I_{66}$. Thus, the voltage generated across resistor 62 is predominantly caused by current $I_{66}$.

Currents $I_{66}$, $I_{42}$, and $I_{48}$ are the output currents regulated by current regulator 60. Transistor 70 supplies the base current for transistors 66, 42, and 48 which in turn sink the currents $I_{66}$, $I_{42}$, and $I_{48}$, respectively. The current $I_{66}$ flowing through resistor 62 generates a feedback voltage signal for the feedback loop of current regulator 60. When the voltage across resistor 62 is less than the reference voltage, $V_{ref}$, transistor 36 of bias generator 14 turns off. The path for current $I_{72}$ into transistors 32 and 36 is changed as transistor 36 turns off, such that current $I_{72}$ supplies additional current to the base of transistor 70. When transistor 70 conducts more current, the bases of transistors 66, 42 and 48 are supplied with additional current. With transistor 36 turned off, transistor 32 supplies base current to transistor 34 which approaches saturation. Thus, when current $I_{66}$ has a value lower than a predetermined value, e.g., one-hundred microamps, the voltage at node 63 is in the feedback loop to terminal 33 of bias generator 14. The low voltage at terminal 33 causes bias generator 14 to increase the base current of transistor 70, which, in turn, increases the base current of transistor 66 to provide current regulation to transistors 66, 42, and 48.

The value of the selected current for current $I_{66}$ determines the amount of current $I_{72}$ supplied by current source 72. For example, current $I_{72}$ may be selected to have a value at least equal to the current $I_{66}$ divided by $\beta^2$, where $\beta$ is the current gain for transistors 66 and 70. For instance, with $\beta$ having a value of about one-hundred, $I_{72}$ can be selected to have a value of about $I_{66}/100$. By way of example, the current $I_{28}$ is selected to be about ten percent of the current $I_{72}$. Therefore, the total current of $(I_{28}+I_{72}+I_{66})$ is about $(I_{66}/1000+I_{66}/100+I_{66})$, respectively. For this example, the total current is equal to $((1.011)*I_{66})$ and has about 1.1 percent of the current used for generating the bias currents.

As shown in FIG. 2, the commonly connected base terminals for transistors 42 and 48 and transistor 66 of reference circuit 57 are driven with current supplied by transistor 70. Although current sink circuit 26 is shown as being comprised of two transistors having commonly coupled bases, it should be understood this is not a limitation of the present invention. For example, current sink circuit 26 could have more than two transistors or less than two transistors. Further, current sink circuit 26 can have different numbers of current conducting terminals and resistors.

Figure 3:
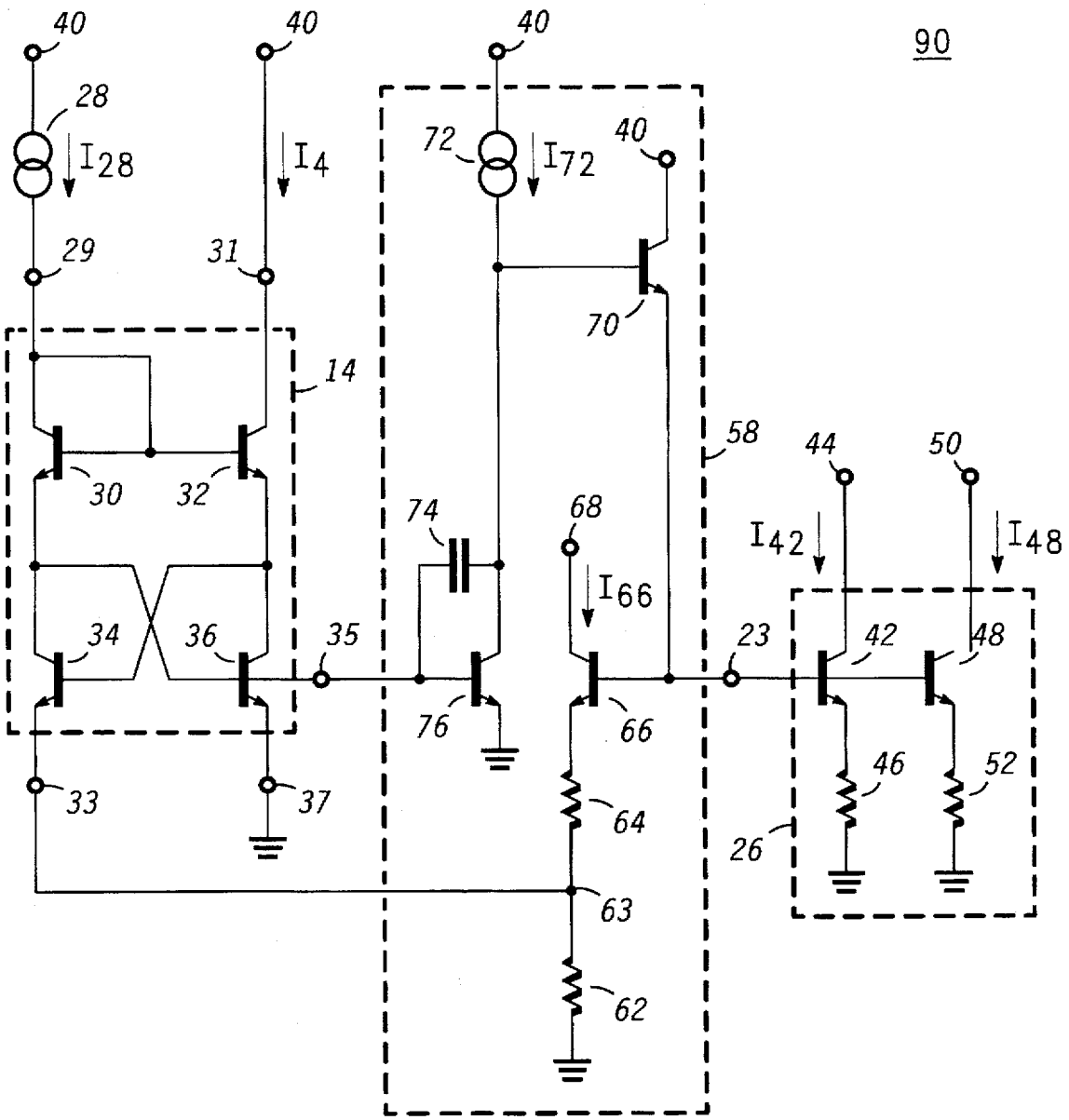
FIG. 3 is a schematic diagram of a current regulator system in accordance with a second embodiment of the present invention.

FIG. 3 is a schematic diagram of current regulator 90 in accordance with a second embodiment of the present invention. Current regulator 90 is comprised of current source 28, bias generator 14, reference circuit 58, and current sink circuit 26. It should be understood that the same reference numerals are used in the figures to denote the same elements.

Reference circuit 58 is comprised of current source 72, NPN transistors 66, 70, and 76, resistors 62 and 64, and capacitor 74. It should be noted that the differences between current regulator 60 (FIG. 2) and current regulator 90 (FIG. 3) are: (1) the presence of transistor 76 in current regulator 90; and (2) terminal 31 is not connected to current source $I_{72}$, the base of transistor 70 or to capacitor 74. Current $I_4$ flowing into terminal 31 of bias generator 14 is supplied by the positive operating potential at terminal 40. The base terminal of transistor 76 is connected to output terminal 35 which serves as the current steering output terminal of bias generator 14. A steering output voltage is supplied at terminal 35. The emitter of transistor 76 is connected to ground. Capacitor 74 is connected between the base and collector terminals of transistor 76. In this second embodiment, the collector of transistor 76 is commonly connected to the base of transistor 70 and to a terminal of current source 72.

In operation, a feedback loop is established for adjusting and regulating the currents $I_{42}$ and $I_{48}$ of transistors 42 and 48, respectively, of current sink circuit 26 and current $I_{66}$ of transistor 66 of reference circuit 58. Bias generator 14 generates a reference voltage having a value $V_{ref}$ which appears at terminal 33. The current $I_{66}$ flowing through resistor 62 generates a voltage for the feedback loop of current regulator 90. Again, the current from transistor 34 of bias generator 14 flowing into resistor 62 is small in comparison to the current $I_{66}$. Thus, the voltage drop across resistor 62 is predominantly caused by current $I_{66}$.

When the voltage across resistor 62 is less than the reference voltage, $V_{ref}$, transistor 36 of bias generator 14 turns off. As transistor 36 turns off, less current is supplied to the base of transistor 76. When transistor 76 conducts less current, the base of transistor 70 is supplied with additional current from current source 72. The additional base current to transistor 70 provides additional base drive to transistor 66, which increases the collector current $I_{66}$ of transistor 66. Thus, when a current $I_{66}$ has a value lower than a desired value of, for example, one-hundred microamps, bias generator 14 and reference circuit 58 operate to increase current $I_{66}$ and provide current regulation.

By way of example, the transistor emitter areas are selected such that the current $I_{28}$ has a value of about $I_4/10$. Transistor 76 is selected to have an emitter area that is about ten times the size of the emitter area of transistor 36, thus current $I_4$ is equal to about $I_{72}/10$. Similarly, the transistors are sized such that current $I_{72}$ has a value of about $I_{66}/100$. Therefore, the current $I_{66}$ has a value that is about a factor of ten thousand times the value of current $I_{28}$, i.e., the biasing current is a small part of the regulated current $I_{66}$.

Current regulator 90 is suitable in applications in which a large signal is applied to terminal 23 of current sink circuit 26 because the feedback is strong enough to prevent transistor 76 from saturating.

Figure 4:
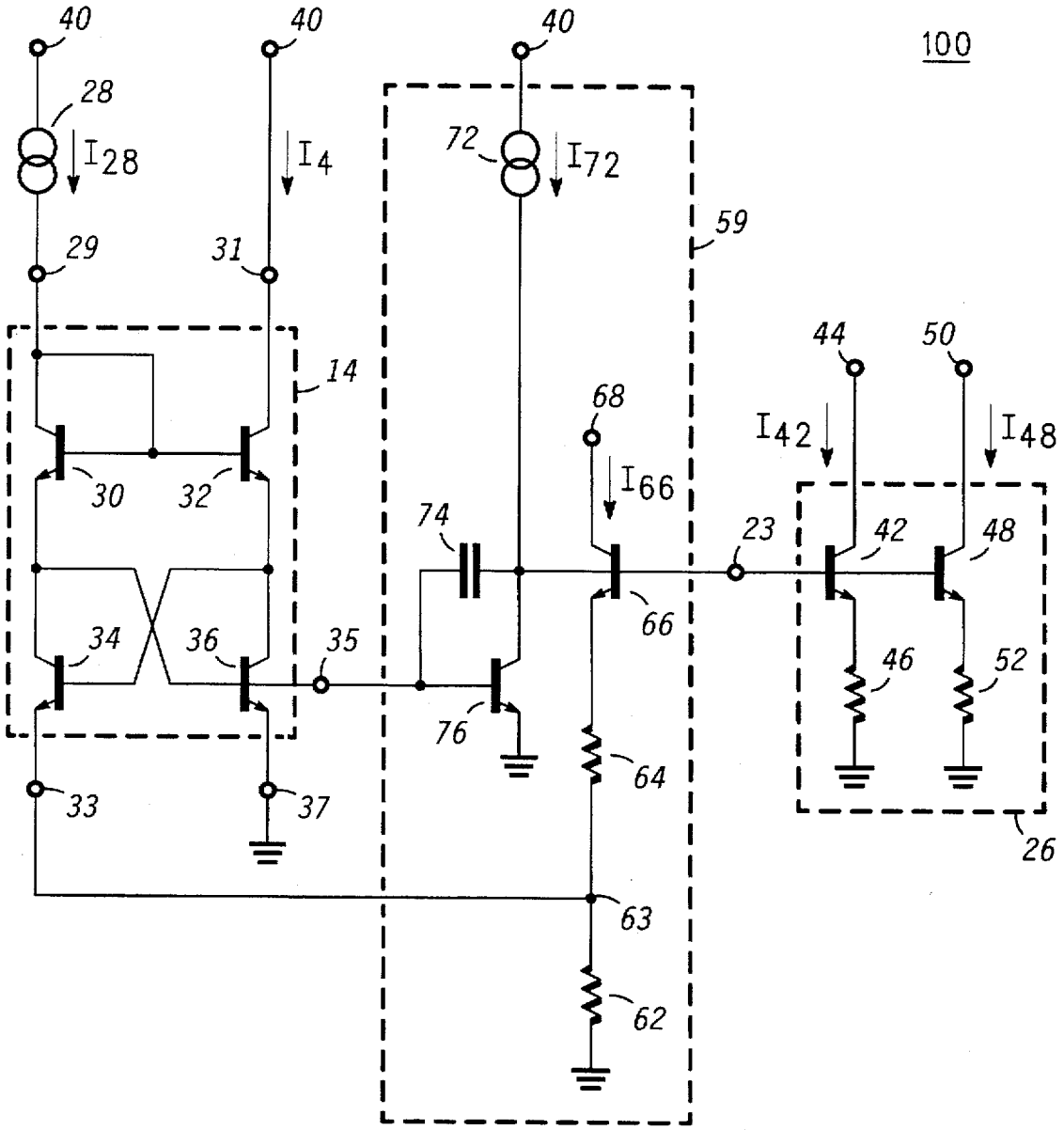
FIG. 4 is a schematic diagram of a current regulator system in accordance with a third embodiment of the present invention.

FIG. 4 is a schematic diagram of current regulator 100 in accordance with a third embodiment of the present invention. Current regulator 100 includes current source 28, bias generator 14, reference circuit 59, and current sink circuit 26. It should be understood that the same reference numerals are used in the figures to denote the same elements.

Reference circuit 59 is comprised of current source 72, NPN transistors 66 and 76, resistors 62 and 64, and capacitor 74. Reference circuit 59 has a current source 72 supplying a current $I_{72}$. By way of example, current source 72 supplies a current having a value of about fifty microamps. It should be noted that the differences between current regulator 90 (FIG. 3) and current regulator 100 (FIG. 4) are: (1) transistor 70 is not present in current regulator 100, and (2) the base of transistor 66 is connected to the collector of transistor 76.

In operation, a feedback loop is established for adjusting and regulating the current in transistors 42 and 48 of current sink circuit 26 and transistor 66 of reference circuit 59. Bias generator 14 generates a reference voltage having a value $V_{ref}$ which appears at terminal 33. The current $I_{66}$ flowing through resistor 62 generates a voltage across resistor 62 which is fed back to bias generator 14. Again, the current from transistor 34 of bias generator 14 flowing into resistor 62 is small in comparison to the current $I_{66}$. Thus, the voltage drop across resistor 62 is predominantly caused by current $I_{66}$.

When the voltage across resistor 62 is less than the reference voltage, $V_{ref}$, transistor 36 of bias generator 14 turns off. As transistor 36 turns off, less current is supplied to the base of transistor 76. When transistor 76 conducts less current, the base of transistor 66 is supplied with additional current from current source 72. The additional base current to transistor 66 increases the collector current $I_{66}$ of transistor 66. Thus, when a current $I_{66}$ has a value lower than a predetermined value, e.g., one-hundred microamps, bias generator 14 and reference circuit 59 operate to increase current $I_{66}$ and provide current regulation.

Current regulator 100 is suitable for applications requiring low voltage operation. For example, when current $I_{66}$ has a value of about one-hundred microamps, a voltage drop across resistor 62 of about 0.1 volts is generated. Thus, the sum of the voltage drops across resistors 62 and 64 and the base-emitter voltage ($V_{be}$) of transistor 66 provide a voltage of about 1.2 volts at terminal 23 of current sink circuit 26.

Figure 5:
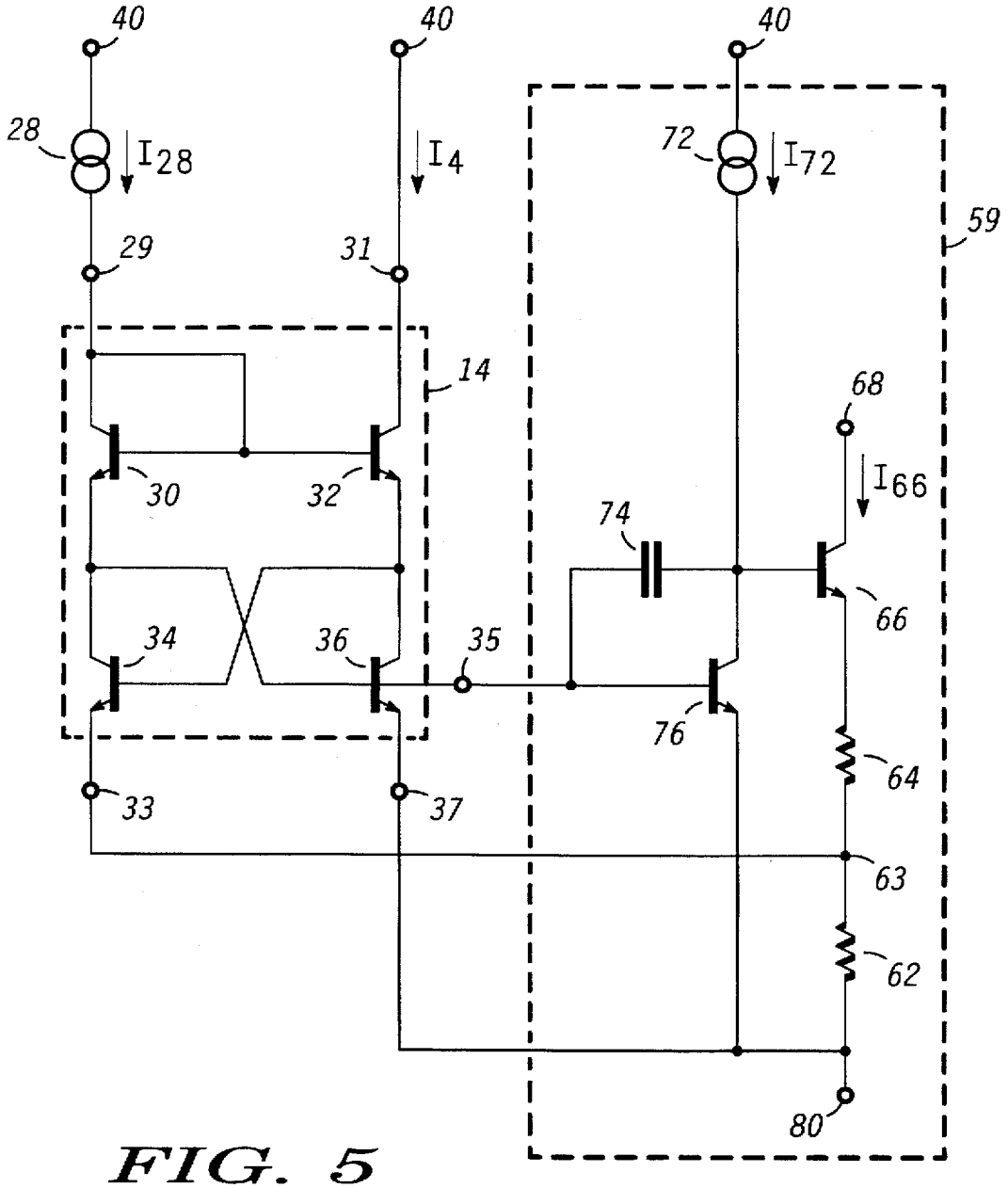
FIG. 5 is a schematic diagram of a current regulator system in accordance with a fourth embodiment of the present invention.

FIG. 5 is a schematic diagram of current regulator 110 in accordance with a fourth embodiment of the present invention. Current regulator 110 is comprised of current source 28, bias generator 14 and reference circuit 59. It should be understood that the same reference numerals are used in the figures to denote the same elements.

Reference circuit 59 is comprised of current source 72, NPN transistors 66 and 76, resistors 62 and 64, and capacitor 74. Terminal 80 serves as a current source terminal and terminal 68 serves as a current sink terminal. It should be noted that the differences between current regulator 110 (FIG. 5) and current regulator 100 (FIG. 4) are: (1) the absence of current sink circuit 26, and (2) terminal 37 is commonly connected to the emitter of transistor 76, to the second terminal of resistor 62, and to terminal 80.

In operation, a feedback loop is established for adjusting and regulating the current in transistor 66 of reference circuit 59.

The voltage difference between terminal 68 and terminal 80 of current regulator 110 is referred to as a dropout voltage ($VH_{min}$). The dropout voltage is the minimum voltage across the current source, as measured from terminal 68 to terminal 80, for which a current source provides an accurate current. $V_{sat}$ is the saturation voltage value of transistor 66 and is the minimum collector-emitter voltage whereby $\alpha$ is greater than one. The dropout voltage, $VH_{min}$, associated with current regulator 110 has a value given by the equation:

$$VH_{min}=V_{sat}+(1+R64/R62)V_T\ln((A32*A34)/(A30*A36))$$

where:

$V_T$ is the thermal voltage kT/q;

k is Boltzmann's constant;

q is the electronic charge;

T is the absolute temperature (degrees Kelvin); and

A30, A32, A34, and A36 are the emitter areas of transistors 30, 32, 34, and 36, respectively.

By way of example, current sources $I_{28}$, $I_{66}$ and $I_4$ have values of about ten microamps, one hundred microamps, and ten microamps, respectively. Also, R62 and R64 have values of about one thousand ohms and about two thousand ohms, respectively.

Current regulator 110 is a floating current source having applications in the second gain stage of an operational amplifier. PNP transistor pairs configured as a current mirror (not shown) can be coupled to NPN transistor pairs configured as a current mirror (not shown) through current regulator 110 operating as a floating current source. For instance, the PNP transistors of the current mirror are connected to terminal 68 and the NPN transistors of the current mirror are connected to terminal 80. Current regulator 110 provides accurately matched source and sink currents and allows a low voltage drop across current regulator 110.

By now it should be appreciated that a structure and method have been provided for generating a regulated sink current. Bias generator 14 provides a reference voltage $V_{ref}$ for comparison with a voltage generated by a feedback loop in accordance with the regulated output current. The current regulators minimize the quiescent currents by efficiently providing the regulated output currents. The currents in bias generator 14 can be less than two percent of the overall current of the current regulator.

While specific embodiments of the present invention have been shown and described, further modifications and improvements will occur to those skilled in the art. It is understood that the invention is not limited to the particular forms shown and it is intended for the appended claims to cover all modifications which do not depart from the spirit and scope of this invention. For instance the embodiments have been described with transistors, however, Metal Oxide Semiconductor Field Effect Transistors (MOSFETs) could be used.

What is claimed is:

1. A bias current regulator circuit, comprising:

a bias generator having a comparison input terminal, a current steering output terminal, and a bias current input terminal; and a feedback circuit having a reference voltage output node, a current steering input terminal, a regulated current output terminal, and a bias current control terminal, wherein the reference voltage output node is coupled to the comparison input terminal, the current steering input terminal is coupled to the current steering output terminal, and the regulated current output terminal provides a first regulated output current.

2. The bias current regulator circuit of claim 1, wherein the feedback circuit further comprises:

a first transistor having a collector, a base, and an emitter, wherein the collector is coupled to the regulated current output terminal and the base is coupled to the bias current control terminal;

a first resistor having first and second terminals, wherein a first terminal is coupled to the emitter of the first transistor; and a second resistor having first terminal and second terminals, wherein the first terminal of the second resistor is coupled to the second terminal of the first resistor and to the reference voltage output node.

3. The bias current regulator circuit of claim 2, wherein the feedback circuit further comprises:

a capacitor having first and second terminals, wherein the first terminal is coupled to the current steering input terminal; and a first current source having a first terminal coupled to a first power supply terminal for receiving a first power supply voltage and a second terminal coupled to the second terminal of the capacitor.

4. The bias current regulator circuit of claim 3, wherein the feedback circuit further comprises a second transistor having a collector, a base, and an emitter, wherein the collector is coupled to the second terminal of the capacitor and the base is coupled to the current steering input terminal.

5. The bias current regulator circuit of claim 4, wherein the collector of the second transistor is coupled to the base of the first transistor, and the emitter of the second transistor and the second terminal of the second resistor are coupled to a second power supply terminal for receiving a second power supply voltage.

6. The bias current regulator circuit of claim 4, wherein the collector of the second transistor is coupled to the base of the first transistor, and the emitter of the second transistor and the second terminal of the second resistor are coupled to a current source terminal.

7. The bias current regulator circuit of claim 3, wherein the feedback circuit further comprises a second transistor having a collector, a base, and an emitter, wherein the collector is coupled to the first power supply terminal for receiving a first power supply voltage, the base is coupled to the second terminal of the capacitor, and the emitter is coupled to the base of the first transistor.

8. The bias current regulator circuit of claim 1, further comprising a current source having first and second terminals, wherein the first terminal is coupled to a first power supply terminal for receiving a first power supply voltage and the second terminal is coupled to the bias current input terminal.

9. The bias current regulator circuit of claim 1, further comprising a current sink circuit having an input terminal and a current conducting output terminal, wherein the input terminal is coupled to the bias current control terminal and the current conducting output terminal supplies a second regulated output current.

10. The bias current regulator circuit of claim 1, wherein the bias generator comprises:

a first transistor having a collector, a base, and an emitter, wherein the collector is coupled to the base and to the bias current input terminal;

a second transistor having a collector, a base, and an emitter, wherein the collector is coupled to a first power supply terminal for receiving a first power supply voltage and the base is coupled to the base of the first transistor;

a third transistor having a collector, a base, and an emitter, wherein the collector is coupled to the emitter of the first transistor, the base is coupled to the emitter of the second transistor, and the emitter is coupled to the comparison input terminal; and a fourth transistor having a collector, a base, and an emitter, wherein the collector is coupled to the emitter of the second transistor, the base is coupled to the emitter of the first transistor and to the current steering output terminal, and the emitter is coupled to a second power supply terminal for receiving a second power supply voltage.

11. A current regulator, comprising:

a first transistor having a control electrode and first and second current carrying electrodes, wherein the first current carrying electrode is coupled to a regulated current output terminal;

a first resistor having first and second terminals, wherein the first terminal is coupled to the second current carrying electrode of the first transistor;

a second resistor having first and second terminals, wherein the first terminal is coupled to the second terminal of the first resistor to form a reference voltage output node;

a bias generator responsive to an electrical signal appearing at the reference voltage output node and having a current steering output terminal; and a second transistor having a control electrode and first and second current carrying electrodes, wherein the control electrode is coupled to the current steering output terminal.

12. The current regulator of claim 11, wherein the first and second transistors are bipolar transistors.

13. The current regulator of claim 12, wherein the second current carrying electrode of the second transistor is coupled to the control electrode of the first transistor.

14. The current regulator of claim 12, wherein the first current carrying electrode of the second transistor is coupled to the control electrode of the first transistor.

15. The current regulator of claim 11, further including a capacitor having first and second terminals, wherein the first terminal is coupled to the current steering terminal and the second electrode is coupled to the control electrode of the second transistor.

16. The current regulator of claim 11, further including a current sink circuit coupled to the control electrode of the first transistor.

17. A method for generating a regulated output current comprising the steps of:

generating a predetermined voltage in a bias generator;

generating a reference voltage output in a reference circuit;

comparing the predetermined voltage to the reference voltage output to form a comparison result; and feeding the comparison result back to the reference circuit to generate a regulated output current.

18. The method of claim 17 wherein the step of comparing the predetermined voltage to the reference voltage output comprises the step of comparing using the bias generator and generating a current steering output voltage in accordance thereof.

* * * * *